US009494160B2

(12) United States Patent
Tomita et al.

(10) Patent No.: US 9,494,160 B2
(45) **Date of Patent: *Nov. 15, 2016**

(54) CENTRIFUGAL COMPRESSOR IMPELLER

(75) Inventors: Isao Tomita, Tokyo (JP); Toru Hoshi, Tokyo (JP); Tadashi Kanzaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 581 days.

This patent is subject to a terminal disclaimer.

(21) Appl. No.: 13/877,678

(22) PCT Filed: Dec. 6, 2011

(86) PCT No.: PCT/JP2011/078200

§ 371 (c)(1),
(2), (4) Date: Apr. 17, 2013

(87) PCT Pub. No.: WO2012/090656

PCT Pub. Date: Jul. 5, 2012

(65) Prior Publication Data

US 2013/0272861 A1 Oct. 17, 2013

(30) Foreign Application Priority Data

Dec. 27, 2010 (JP) ..... 2010-291332

(51) Int. Cl.
*F04D 29/28* (2006.01)
*F04D 29/30* (2006.01)
*F04D 17/10* (2006.01)

(52) U.S. Cl.
CPC ..... *F04D 17/10* (2013.01); *F04D 29/284* (2013.01); *F04D 29/30* (2013.01)

(58) Field of Classification Search
CPC ..... F04D 29/30; F04D 29/284
See application file for complete search history.

(56) References Cited

U.S. PATENT DOCUMENTS 4,543,041 A * 9/1985 French ..... F04D 29/30 416/183
5,002,461 A * 3/1991 Young ..... F04D 29/284 416/183

(Continued)

FOREIGN PATENT DOCUMENTS

CN 1112520 C 6/2003
CN 1842657 A 10/2006

(Continued)

OTHER PUBLICATIONS

Chinese Office Action effective Mar. 24, 2015 issed in corresponding Chinese Application No. 201180048910.1 with an English translation.

(Continued)

*Primary Examiner* — Christopher Verdier
*Assistant Examiner* — Brian O Peters
(74) *Attorney, Agent, or Firm* — Birch, Stewart, Kolasch & Birch, LLP

(57) ABSTRACT

Provided is a centrifugal compressor impeller which is characterized in that leading edges 7*a* on a shroud side of splitter blades 7 are offset from a circumferentially equidistant position between full blades 5R and 5F toward a suction side Sb of the full blade 5F, and trailing edges 7*b* on a hub side of the splitter blades 7 are offset from a circumferentially equidistant position between the full blades toward the suction side Sb of the full blade 5F, so that a tip leakage vortex W flowing from a tip clearance between the tips of the full blades 5F and the shroud toward the leading edges 7*a* of the splitter blades 7 flows over the leading edges 7*a* of the splitter blades 7.

4 Claims, 7 Drawing Sheets

(56) References Cited

U.S. PATENT DOCUMENTS

| | | | | |
|---|---|---|---|---|
| 6,508,626 | B1 | 1/2003 | Sakurai et al. | |
| 2010/0254816 | A1* | 10/2010 | Dettmann | F04D 29/30 416/223 A |
| 2013/0266450 | A1* | 10/2013 | Tomita | F04D 29/284 416/223 R |

FOREIGN PATENT DOCUMENTS

| | | | |
|---|---|---|---|
| CN | 101173672 | A | 5/2008 |
| CN | 101173673 | A | 5/2008 |
| JP | 56-115597 | | 9/1981 |
| JP | 10-213094 | A | 8/1998 |
| JP | 2002-516960 | A | 6/2002 |
| JP | 2002-332992 | A | 11/2002 |
| JP | 3876195 | B2 | 1/2007 |
| WO | WO99/61800 | A1 | 12/1999 |

OTHER PUBLICATIONS

International Preliminary Report on Patentability and Written Opinion of the International Searching Authority (Forms PCT/IB/338, PCT/IB/373, PCT/ISA/237, and PCT/IB/326) for International Apln. No. PCT/JP2011/078200, dated Jul. 11, 2013.

Decision to Grant a Patent dated May 30, 2014 issued in Corresponding JP Application No. 2010-291332 with an English Translation.

Chinese Notice of Allowance and Search Report for Chinese Application No. 201180048910.1, dated May 4, 2016, with an English translation of the Notice of Allowance only.

* cited by examiner

CIRCUMFERENTIAL POSITION ON HUB SIDE

FRONT EDGE SHAPE OF SPLITTER BLADE

REAR EDGE SHAPE OF SPLITTER BLADE

CIRCUMFERENTIAL POSITION ON SHROUD SIDE

CIRCUMFERENTIAL POSITION ON HUB SIDE (A)

(B)

CENTRIFUGAL COMPRESSOR IMPELLER

TECHNICAL FIELD

The present invention relates to a centrifugal compressor impeller used in a turbocharger or the like in vehicles or ships, and more particularly to the blade shape of the splitter blade provided between full blades adjoining each other.

BACKGROUND ART

Centrifugal compressors used in a compressor part or the like of turbochargers in vehicles or ships give a kinetic energy to a fluid through rotation of a vaned wheel and discharge the fluid radially outward by the centrifugal force to raise the fluid pressure. In response to the demands for a high pressure ratio and high efficiency in a wide operation range of such centrifugal compressors, impellers (vaned wheels) 05 having splitter blades 03 each arranged between full blades 01 adjoining each other as shown in FIG. 13 and FIG. 14 are commonly used, and various improvements have been made to the blade shapes.

Such impeller 05 with splitter blades 03 includes the full blades 01 and the splitter blades 03 arranged alternately on the surface of a hub 07. Common splitter blades 03 have the same shape as the full blades 01 with their upstream sides simply cut off.

The leading (LE2) of the commonly known splitter blade 03 is located a preset distance downstream of the leading (LE1) of the full blade 01 as shown in FIG. 15, while the trailing edges (TE) are placed at the same position. The blade angle θ at the leading of the splitter blade 03 (indicated as an angle made between the direction of the leading edge and the axial direction G of the impeller 05) is set the same as that of the flow direction F of the fluid flowing through the flow passage between the full blades 01.

Meanwhile, techniques of making the throat areas of two passages formed on both sides of each splitter blade 03 equal so as to distribute the fluid evenly have been known. Patent Document 1 (Japanese Patent Application Laid-open No. H10-213094), for example, discloses a technique in which, as shown in FIG. 16, the blade angle θ at the leading of the splitter blade 09 is set larger to be θ+Δθ, (the angle is set larger by Δθ relative to the flow direction F of the fluid), i.e., the splitter blade is positioned closer to the suction side Sb of the full blade 01, in order to make the throat areas of the passages on both sides of the splitter blade 09 equal (A1=A2).

The positioning of the inlet end of the splitter blade inclined to the suction side of the full blade is also known from the disclosure in Patent Document 2 (Japanese Patent Publication No. 3876195).

Patent Document 1: Japanese Patent Application Laid-open No. H10-213094

Patent Document 2: Japanese Patent Publication No. 3876195

The techniques shown in Patent Documents 1 and 2 both relate to an improvement in the blade shape in respect of flow rate distribution in flow passages divided by the splitter blade based on an assumption that the fluid between the blades flows along the full blades. In open type impellers with a tip clearance, the flow field is complex due to the tip leakage flow coming into or out of the passage through the tip clearance, because of which a further improvement was needed to the blade shape to better adapt to such complex internal flow.

An evaluation of such complex internal flow through a numerical analysis revealed that the tip leakage vortex (vortex flow leaking at the blade tip as shown in FIG. 12, hereinafter referred to as "tip leakage vortex W") generated from the tip of the leading of the full blade (the distal end of the blade (on the shroud side) in the direction of height from the hub surface) reached the vicinity of the tip of the leading of the splitter blade (the distal end of the blade (on the shroud side) in the direction of height from the hub surface).

In view of this, the present applicant filed a patent application (Japanese Patent Application No. 2009-233183, not published yet) relating to a technique of preventing the tip leakage vortex W from interfering with the splitter blade by inclining the leading of the splitter blade toward the suction side of the full blade.

While the blade shape is improved in respect of flow rate distribution in flow passages divided by the splitter blade in Patent Documents 1 and 2 mentioned above, the previous application filed by the present applicant relates to prevention of tip leakage vortex W from interfering with the leading of the splitter blade. Through further research, the present inventors have found out that even distribution of load between the shroud side and the hub side of the splitter blade (uniform blade load application) is effective to further improve the impeller performance.

Thus there is the problem that, if the blade load distribution is not even between the shroud side and the hub side of the splitter blade, separation or the like may occur on the blade surface that bears more load, which inhibits a further increase of pressure ratio of the compressor. Uneven blade load distribution is also problematic in terms of durability as it can easily cause deformation of the splitter blade.

DISCLOSURE OF THE INVENTION

Accordingly, the present invention was made in view of these problems. An object of the invention is to provide a centrifugal compressor impeller that can achieve higher efficiency and improved durability through an increase in pressure ratio by making the load distribution even between the shroud side and the hub side of splitter blades.

To solve the problems described above, the present invention provides a centrifugal compressor impeller including a plurality of full blades that stand equally spaced in a circumferential direction and extend from a fluid inlet part to a fluid outlet part on a surface of a hub, and splitter blades each provided to extend from a point in a flow passage formed between the full blades arranged adjacent each other, to the outlet part.

The centrifugal compressor includes a tip clearance between tips of the full blades and a shroud. Leading edge portions on a shroud side of the splitter blades are offset from a circumferentially equidistant position between the full blades toward a suction side of the full blade, while trailing edge portions on a hub side of the splitter blades are offset from the circumferentially equidistant position between the full blades toward the suction side of the full blade, so that a tip leakage vortex flowing from the tip clearance toward the leading edge portions of the splitter blades flows over the leading edge portions of the splitter blades, or so that the leading edge portions conforms to a direction of the tip leakage vortex.

With this invention, in the centrifugal compressor wherein a tip clearance is present between tips of the full blades and a shroud, leading edge portions on a shroud side of the splitter blades are offset from a circumferentially equidistant position between the full blades toward a suction side of the full blade, so that a tip leakage vortex flowing from the tip clearance toward the leading edge portions of the splitter blades flows over the leading edge portions of the splitter blades, or so that the leading edge portions conforms to a direction of the tip leakage vortex. Thereby, the interference with the tip leakage vortex due to the flow leaking at the tip is prevented, and the efficiency and performance of the compressor are improved. The direction of the tip leakage vortex can be determined by numerical studies or bench tests.

Moreover, as trailing edge portions on a hub side of the splitter blades are offset from the circumferentially equidistant position between the full blades toward the suction side of the full blade, the blade curvature (blade load) is increased on the hub side, whereby the pressure ratio of the compressor as a whole can be improved.

In improving the pressure ratio, since the shroud side is already offset toward the suction side of the full blade for avoidance of the tip leakage vortex to have a larger blade curvature (higher blade load), there is a risk that separation may occur there. Therefore the trailing edge portions on the hub side are offset from the circumferentially equidistant position between the full blades toward the suction side of the full blade.

As the blade load is increased on the shroud side and on the hub side, an even balance can be achieved between the shroud side and the hub side of the splitter blades. The risk of separation or the like is reduced by lowering the load on the shroud side, and the overall performance and durability of the compressor can be improved by the increase in load on the hub side.

Moreover, as the full blades and the splitter blades are positioned at unequal intervals in the circumferential direction, an effect of reducing compressor noise due to a relationship between the rotation number of the centrifugal compressor and the number of blades can be achieved.

In the present invention, preferably, the trailing edge portions on the shroud side of the splitter blades may be offset from the circumferentially equidistant position between the full blades toward a pressure side of the full blade.

The blade load on the shroud side can be reduced by offsetting the trailing edge portions on the shroud side of the splitter blades toward the pressure side of the full blade.

That is, the shroud side is subjected to a large blade load as the leading edge portions on the shroud side are offset toward the suction side of the full blade for avoidance of interference with the tip leakage vortex. Accordingly, the trailing edge portions on the hub side are offset from the circumferentially equidistant position between the full blades toward the suction side of the full blade.

However, this may not be sufficient to counterbalance the increased blade load on the shroud side, and there may still be the risk of separation or the like occurring on the shroud side. Therefore, the trailing edge portions on the shroud side are offset from the circumferentially equidistant position between the full blades toward the pressure side of the full blade, to further lower the load on the shroud side.

In the present invention, preferably, the leading edge portions on the shroud side of the splitter blades may be offset from the circumferentially equidistant position between the full blades toward the suction side of the full blade such that the leading edge portions are positioned at the circumferentially equidistant position between the full blades up to about 70% of a total height of the splitter blades and portions above about 70% of the total height of the splitter blades are inclined from a point corresponding to about 70% of the total height toward distal ends thereof.

In this way, only the portion above about 70% of the total height of the leading edge portion of the splitter blade is inclined from a point corresponding to about 70% of the total height toward the distal end thereof to be closer to the suction side of the full blade, and thus interference with the tip leakage vortex can be prevented as well as equalization of blade load between the full blades and splitter blades can be achieved, whereby a drop in the performance of the compressor as a whole can be prevented due to even blade loading between the full blades and splitter blades.

In the present invention, preferably, ratios of cross-sectional areas at the leading edges and trailing edges of the splitter blades in respective passages divided by the splitter blades at positions with a minimum distance from the splitter blade to a pressure side or a suction side of the full blade may be made uniform.

Namely, the leading edge portions on the shroud side of the splitter blades are offset from the circumferentially equidistant position between the full blades toward the suction side of the full blades, and the trailing edge portions of the splitter blades may be positioned, on the hub side and on the shroud side respectively, such that the ratios of areas at the inlet and outlet of the respective passages divided by the splitter blades are uniform.

The areas at the inlet and outlet refer to ratios of cross-sectional areas at the leading edges and trailing edges at positions with a minimum distance from the splitter blade to the pressure side or suction side of the full blade.

By making the ratios of areas uniform, there will hardly be a pressure difference between the passages divided by the splitter blade, which will prevent the fluid from flowing over the splitter blade, whereby a drop in the compressor performance can be prevented.

According to the present invention, in the centrifugal compressor wherein a tip clearance is present between tips of the full blades and a shroud, leading edge portions on a shroud side of the splitter blades are offset from a circumferentially equidistant position between the full blades toward a suction side of the full blade, so that a tip leakage vortex flowing from the tip clearance toward the leading edge portions of the splitter blades flows over the leading edge portions of the splitter blades, or so that the leading edge portions conforms to a direction of the tip leakage vortex, whereby interference with the tip leakage vortex due to the flow leaking at the tip is prevented, and the efficiency and performance of the compressor are improved.

Moreover, as trailing edge portions on the hub side of the splitter blades are offset from the circumferentially equidistant position between the full blades toward the suction side of the full blade, the blade curvature (blade load) is increased on the hub side, whereby the blade load can be made even between the shroud side and the hub side, as well as the pressure ratio of the compressor as a whole can be improved.

As described above, interference with the tip leakage vortex is prevented, and load distribution is made even between the shroud side and the hub side of the splitter blades so that the pressure ratio can be increased, whereby higher efficiency and better durability can be achieved.

BEST MODE FOR CARRYING OUT THE INVENTION

The illustrated embodiments of the present invention will be hereinafter described in detail.

It should be noted that, unless otherwise specified, the size, material, shape, and relative arrangement or the like of constituent components described in these embodiments are only illustrative examples and not intended to limit the scope of this invention.

First Embodiment

Figure 1:
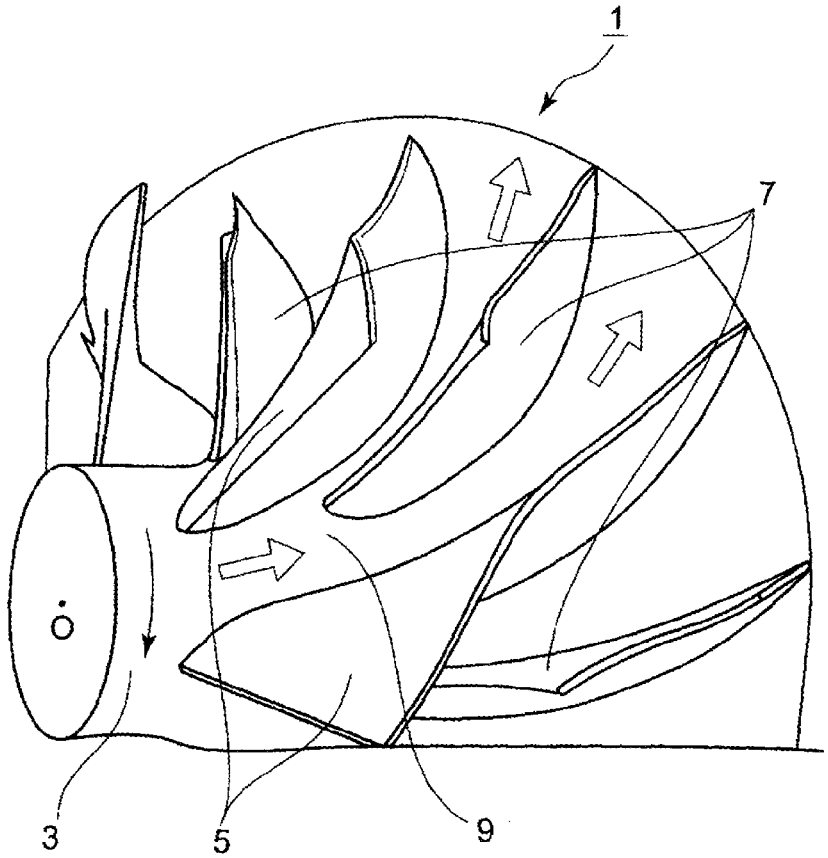
FIG. 1 is a perspective view illustrating essential parts of an impeller with splitter blades of a centrifugal compressor according to the present invention.

FIG. 1 is a perspective view illustrating essential parts of an impeller (vaned wheel) of a centrifugal compressor, to which the splitter blade of the present invention is applied. The impeller 1 includes a plurality of full blades 5 adjoining each other on an upper surface of a hub 3 fitted to a rotor shaft (not shown), and splitter blades 7 each provided in between the full blades 5 such that both blades stand alternately at circumferentially equal intervals. The splitter blades 7 are shorter in the flow direction of fluid than the full blades 5 and extend from a point in a flow passage 9 formed between front and rear full blades 5 to an outlet part. The impeller 1 rotates in the direction of the arrow. The rotation center is denoted by O.

Figure 2:
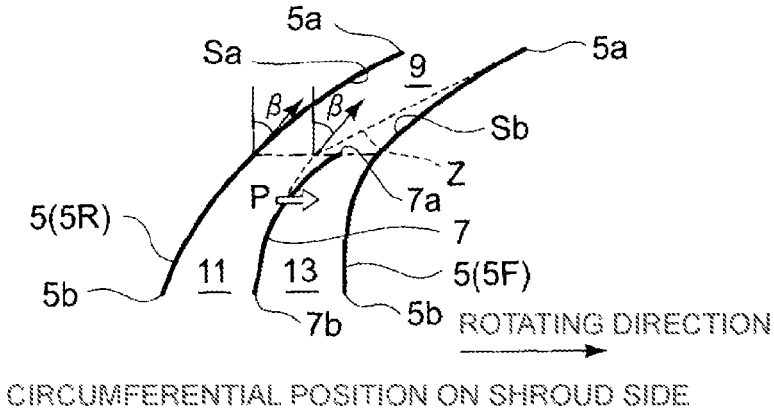
FIG. 2 is an explanatory diagram illustrating the positional relationship between full blades and splitter blades on a shroud side in a circumferential direction in a first embodiment.

FIG. 2 shows the positional relationship between a splitter blade 7 and full blades 5 on the shroud side, i.e., on the blade tip side.

The leading edge 7*a*, or the leading edge, of the splitter blade 7 is located downstream in the flow direction of the leading edge 5*a*, or the leading edge, of the full blade 5. The trailing edge 7*b*, or the trailing edge, of the splitter blade 7, and the trailing edge 5*b*, or the trailing edge, of the full blade 5, are placed at the same position in the circumferential direction.

The splitter blade 7 is positioned such as to split the flow passage 9 formed between a pressure side Sa and a suction side Sb of full blades 5 in two parts in the circumferential direction, so that there are formed a flow passage 11 between the splitter blade 7 and the wall surface on the pressure side Sa of the full blade 5, and a flow passage 13 between the splitter blade and the wall surface on the suction side Sb of the full blade 5.

The splitter blade 7 is shaped to conform to the full blade 5, i.e., the inclination angle β of the leading edge 7*a* of the splitter blade 7 is the same as that of the full blade 5.

The impeller 1 thus configured is housed inside a shroud (not shown) that covers the full blades 5 and the splitter blades 7, and configured as an open type impeller with a tip clearance between the shroud and the blades.

Accordingly, there is generated a tip leakage vortex W of fluid flowing from the pressure side of a full blade 5 on the downstream side in the rotating direction (front side full blade 5F) to the suction side of the full blade 5 through a clearance between the tip of the leading edge 5*a* (shroud side) of the full blade 5 and the shroud.

Figure 12:
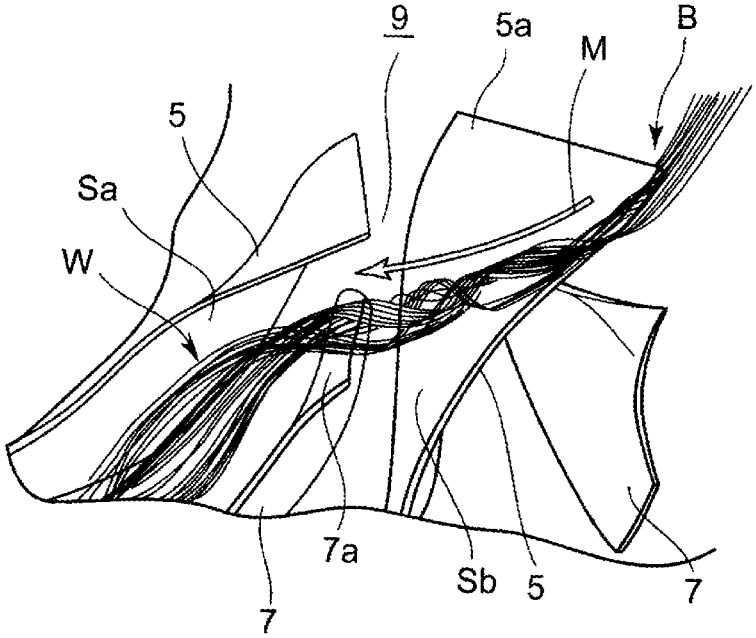
FIG. 12 shows results of a numerical analysis showing a tip leakage flow flowing from the tip of the full blade and formed at the tip of the splitter blade at the inlet end.
Figure 13:
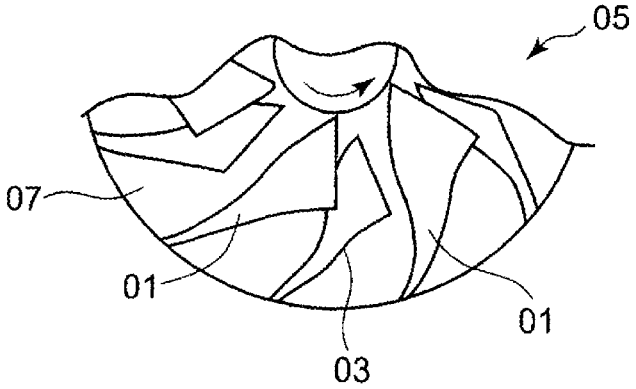
FIG. 13 is a diagram for explaining a conventional technique.
Figure 14:
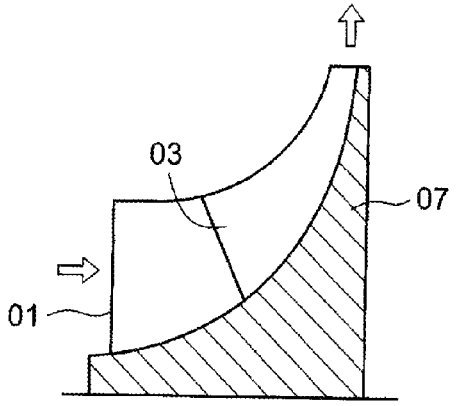
FIG. 14 is a diagram for explaining a conventional technique.
Figure 15:
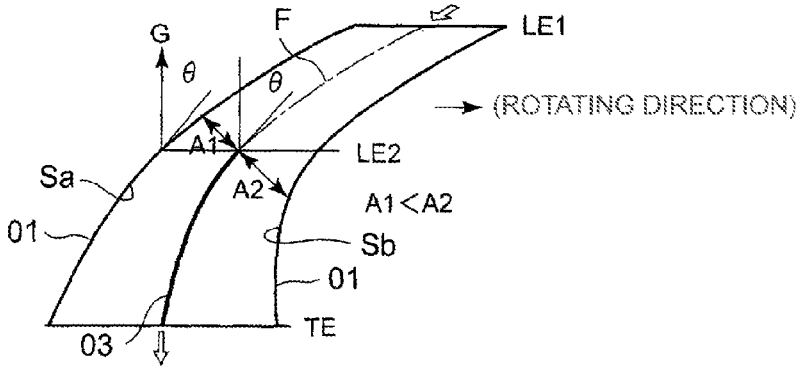
FIG. 15 is a diagram for explaining a conventional technique.
Figure 16:
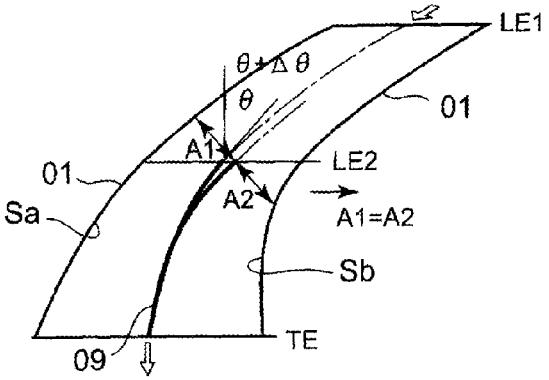
FIG. 16 is a diagram for explaining a conventional technique.

This tip leakage vortex W affects the flow in the vicinity of the leading edge 7*a* of the splitter blade 7. A numerical analysis was thus made as to the conditions of this tip leakage vortex W. FIG. 12 shows a streamline diagram drawn from the results of this numerical analysis.

This tip leakage vortex W involves a strong swirling flow and causes a high blocking effect on the flow along the full blade 5. As a consequence, the fluid does not flow along the full blade 5 near the leading edge 7*a* of the splitter blade 7, and there is created a drift flow M that flows spirally around the swirl toward the leading edge of the splitter blade 7.

The leading edge 7*a* on the shroud side of the splitter blade 7 is offset from the circumferentially equidistant position between full blades 5 toward the suction side Sb of the full blade 5, so that the direction of this tip leakage vortex W, although it may vary depending on the running condition of the compressor, will be such that the fluid flows over the leading edge 7*a* on the shroud side of the splitter blade 7, or such that the leading edge 7*a* substantially faces (conforms to) the flow at the peak efficiency point.

Here, the direction of the tip leakage vortex W at the peak efficiency point is used as the reference direction so as to cover a wide range of operating conditions.

"To substantially face (conform to)" means that the inclination angle β of the leading edge 7*a* on the shroud side of the splitter blade 7 is substantially the same as that of the flow direction of the tip leakage vortex, so that the spiral flow does not interfere (intersect) with the leading edge 7*a* on the shroud side of the splitter blade 7.

The splitter blade 7 is positioned in a middle part between a front side full blade 5F and a rear side full blade 5R, and its leading edge 7*a* is likewise positioned in a middle part in the circumferential direction between the front side full blade 5F and the rear side full blade 5R. The position of the leading edge 7*a* of the splitter blade 7, i.e., its position in the length direction, can be set by various techniques.

For example, it may be set at an intersection between a line Z indicating the direction of the tip leakage vortex W at the peak efficiency point, which may be determined by a numerical analysis or through tests using actual machines, and a midpoint between the front and rear full blades 5F and 5R, as shown in FIG. 2.

Alternatively, it may be set at an intersection between a line Z determined as indicating the direction of the tip leakage vortex and a midpoint between the front and rear full blades 5F and 5R, the line Z being drawn by connecting a center position of the so-called throat where the distance from the leading edge 5*a* of the rear side full blade 5R to the suction side Sb of the front side full blade 5F arranged adjacent the rear side full blade 5R on the front side in the rotating direction is minimum, and the leading edge 5*a* of the front side full blade 5F.

In either method, it is set at an intersection between a line Z that indicates the direction of the tip leakage vortex W determined as a reference, and a midpoint between the front and rear full blades 5F and 5R.

Figure 4:
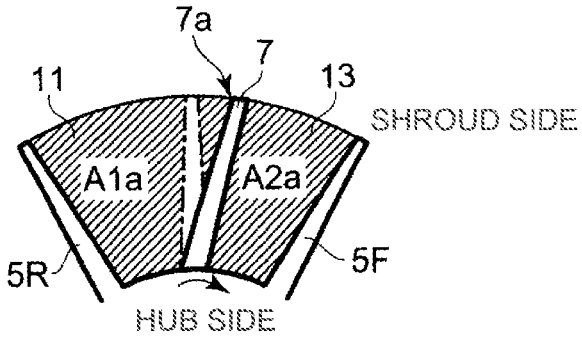
FIG. 4 is a front view relative to a flow direction illustrating a leading edge shape of the splitter blade of the first embodiment.
Figure 5:
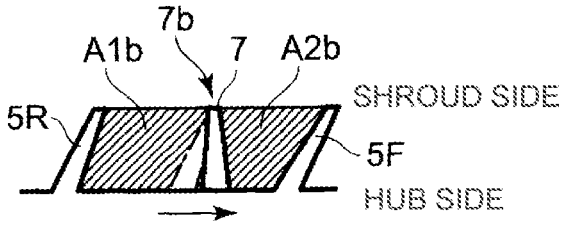
FIG. 5 is a front view relative to a flow direction illustrating a trailing edge shape of the splitter blade of the first embodiment.
Figure 6:
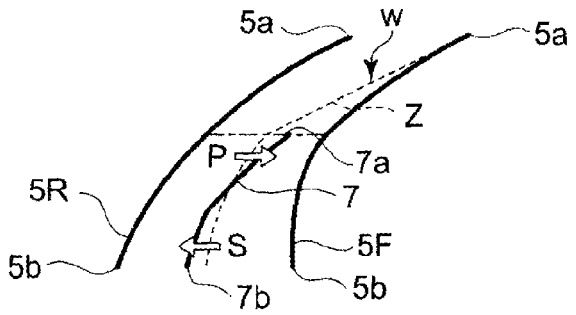
FIG. 6 is an explanatory diagram illustrating the positional relationship between full blades and splitter blades on a shroud side in a circumferential direction in a second embodiment.
Figure 7:
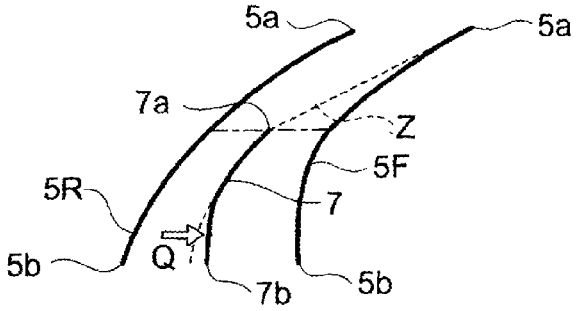
FIG. 7 is an explanatory diagram illustrating the positional relationship between full blades and splitter blades on a hub side in a circumferential direction in the second embodiment.
Figure 8:
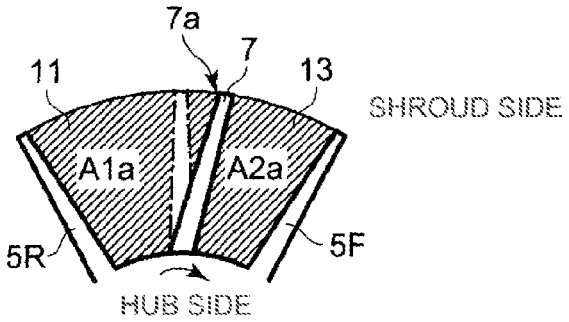
FIG. 8 is a front view relative to a flow direction illustrating a leading edge shape of the splitter blade of the second embodiment.
Figure 9:
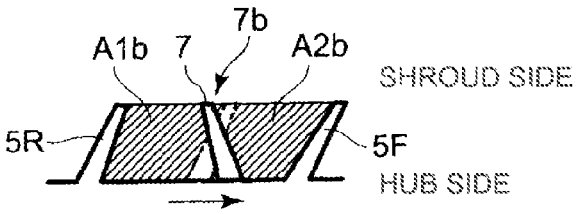
FIG. 9 is a front view relative to a flow direction illustrating a trailing edge shape of the splitter blade of the second embodiment.

The leading edge 7*a* of the splitter blade 7, whose position is set as a reference as described above, is inclined on the shroud side, as shown in FIG. 2, FIG. 4, and FIG. 5, to be offset toward the suction side Sb of the front side full blade 5F. The splitter blade is inclined so that it is more skewed (slanted) than the front side full blade 5F or the rear side full blade 5R standing on the hub 3, as shown in FIG. 4. The trailing edge 7*b* on the shroud side is located at the circumferentially equidistant position.

The offsetting amount of the leading edge 7*a* toward the suction side Sb of the front side full blade 5F may be about 10%, preferably 10% or more, of the distance between the front and rear full blades 5F and 5R. The offsetting may be started at a point about 0.1 to 0.3 of the axial length of the full blade 5 from the tip. These ranges of offsetting amount and starting point were determined effective to avoid interference between the tip leakage vortex and the leading edge 7*a* of the first splitter blade 7 over a wide range of operating conditions of the compressor from a low load operating point to a high load operating point based on simulations and numerical studies, or confirmation results of tests conducted with actual machines.

Figure 3:
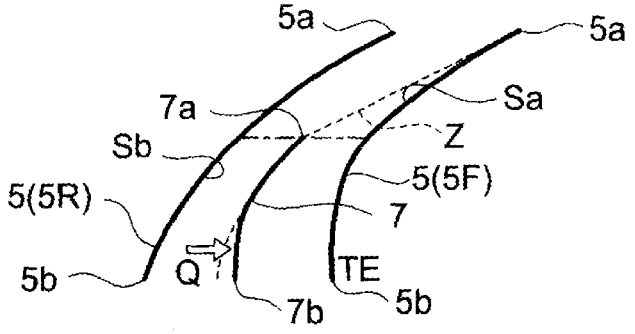
FIG. 3 is an explanatory diagram illustrating the positional relationship between full blades and splitter blades on a hub side in a circumferential direction in the first embodiment.

On the other hand, the leading edge 7*a* on the hub side is located at the circumferentially equidistant position as shown in FIG. 3, FIG. 4, and FIG. 5, while the trailing edge 7*b* is offset toward the suction side Sb of the front side full blade 5F. By offsetting the trailing edge 7*b* toward the suction side Sb of the front side full blade 5F, the splitter blade 7 is more upright than the front side full blade 5F or the rear side full blade 5R relative to the hub 3, as shown in FIG. 5.

As shown in FIG. 2, the shroud side of the splitter blade has a larger blade curvature (higher blade load), as it is offset from the circumferentially equidistant position between the front and rear full blades 5F and 5R toward the suction side Sb of the front side full blade 5F so as to avoid interference with the tip leakage vortex W.

Correspondingly, the hub side is also offset toward the suction side Sb of the front side full blade 5F to increase the blade curvature (blade load).

The blade load on the hub side is thus increased corresponding to the increase in blade load on the shroud side, so as to achieve an even balance of blade load between the hub side and the shroud side of the splitter blade.

The splitter blade is offset in the direction of arrow P in FIG. 2 on the shroud side, and in the direction of arrow Q in FIG. 3 on the hub side, so as to achieve an even balance of blade load between the hub side and the shroud side of the splitter blade, as well as to increase the blade curvature of the splitter blade 7 as a whole, to increase the blade load.

As a result, the risk of separation or the like is reduced, as the blade load is lowered on the shroud side, while the pressure ratio of the compressor as a whole can be increased due to the increased load on the hub side. Furthermore, as the imbalance of load applied to the splitter blade 7 is eliminated, the durability of the impeller 1 can be improved.

In this embodiment, in order to avoid interference with the tip leakage vortex W, as described above, the leading edge 7*a* on the shroud side of the splitter blade 7 is offset, and in addition, the trailing edge 7*b* on the hub side of the splitter blade 7 is offset in order to achieve an even balance of blade load applied to the splitter blade 7.

Further in addition to this, the passage area ratios may be made uniform as described below. That is, the offsetting amount of the leading edge 7*a* on the shroud side of the splitter blade 7 and the offsetting amount of the trailing edge 7*b* on the hub side of the splitter blade 7 may be set such that the ratios of areas at the inlet and outlet of the respective passages 11 and 13 divided by the splitter blade 7 are uniform.

Namely, the offsetting amount of the leading edge 7*a* on the shroud side and the offsetting amount of the trailing edge 7*b* on the hub side may be set such that the ratios of areas A1/A2 at the leading edge 7*a* and trailing edge 7*b* of the splitter blade 7 in the passages 11 and 13 divided by the splitter blade 7 are uniform, the area A1 being the cross-sectional area A1 at a position where the distance to the pressure side Sa of the rear side full blade 5R is minimum, and the area A2 being the cross-sectional area at a position where the distance to the suction side Sb of the front side full blade 5F is minimum.

More specifically, the offsetting amounts are set such that the ratio of areas A1*a*/A1*b* is equal to the ratio of areas A2*a*/A2*b*, A1*a*/A1*b* being the ratio between the inlet area A1*a* and the outlet area A1*b* of the passage 11, and A2*a*/A2*b* being the ratio between the inlet area A2*a* and the outlet area A2*b* of the passage 13.

By making the ratios of areas at the inlet and the outlet uniform in this manner, there will hardly be a pressure difference between the passages 11 and 13 divided by the splitter blade, which will prevent the fluid from flowing over the splitter blade 7, whereby a drop in the compressor performance can be prevented.

Moreover, as the splitter blades 7 arranged between the full blades 5 are inclined, the respective blades are arranged at unequal intervals in the circumferential direction, whereby an effect of reducing compressor noise due to a relationship between the rotation number of the centrifugal compressor and the number of blades can be achieved.

Figure 11:
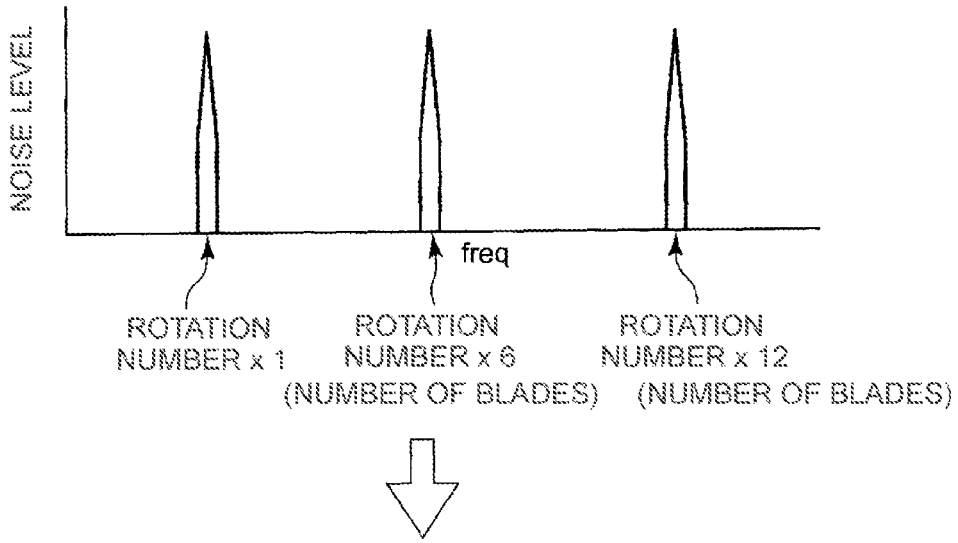
FIG. 11 is an explanatory diagram illustrating a relation between the number of blades and compressor noise.
Figure 11:
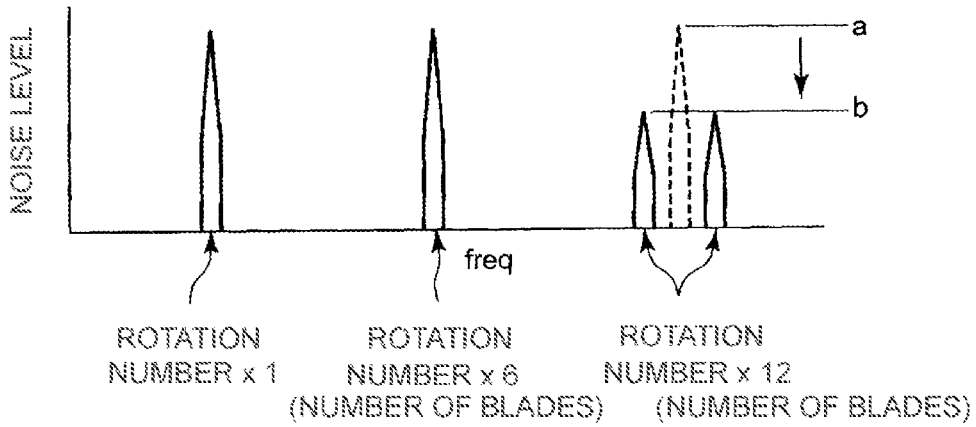

FIG. 11 is a graph showing noise peak values on the vertical axis and resonant frequencies on the horizontal axis. For example, when the circumferential position of the splitter blade is shifted by 10% toward the suction side, the splitter blade-to-blade space is reduced by 20% from the conventional 50% to 40% on one side so that the frequency is increased by 20%. The distance is increased by 20% on the other side from the conventional 50% to 60% so that the frequency is decreased by 20%. As a result, the peak value is reduced from a to b (see FIG. 11(B)) by the phase offset.

Second Embodiment

Next, a second embodiment will be described with reference to FIG. 6 to FIG. 9.

The second embodiment is characterized in that, in addition to the features of the first embodiment, the trailing edge 7*b* on the shroud side of the splitter blade 7 is offset toward the pressure side Sa of the rear side full blade 5R from the circumferentially equidistant position between the front and rear full blades 5F and 5R.

In the first embodiment, in order to avoid interference with the tip leakage vortex W, as described above, the leading edge 7*a* on the shroud side of the splitter blade 7 is offset, and in addition, the trailing edge 7*b* on the hub side of the splitter blade 7 is offset toward the downstream side (front side) in the rotating direction in order to achieve an even balance of blade load applied to the splitter blade 7.

However, the load on the shroud side may not be counterbalanced by offsetting the trailing edge 7*b* on the hub side toward the suction side of the full blade from the circumferentially equidistant position between the full blades, and there is still the risk of separation or the like occurring on the shroud side. In the second embodiment, therefore, the trailing edge 7*b* on the shroud side is offset in the direction of arrow S in FIG. 6 toward the pressure side Sa of the full blade from the circumferentially equidistant position between the full blades, to reduce the blade curvature (blade load) on the shroud side. Thereby, the load on the shroud side can be reduced even more effectively than the first embodiment.

The ratios of areas at the inlet and the outlet may be made uniform, with the same advantageous effects as those of the first embodiment.

Third Embodiment

Figure 10:
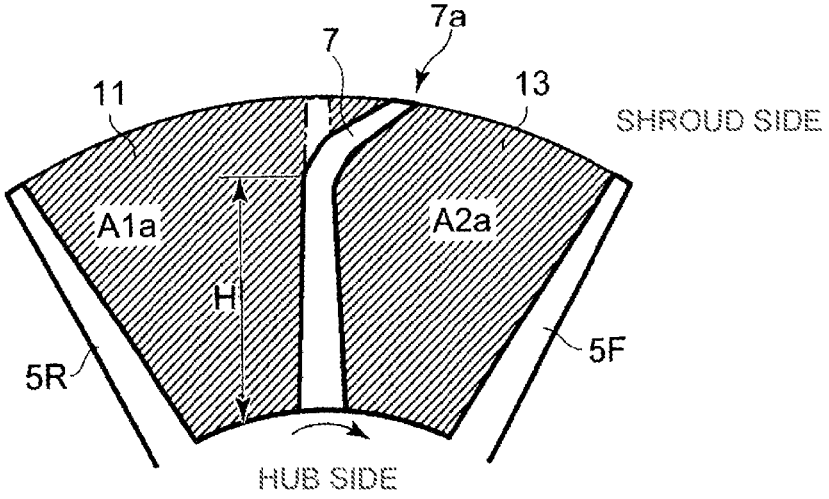
FIG. 10 is a front view relative to a flow direction illustrating a leading edge shape of the splitter blade of a third embodiment.

Next, a third embodiment will be described with reference to FIG. 10.

In the third embodiment, as compared to the first and second embodiments, the leading edge 7*a* of the splitter blade 7 is not linearly inclined from the hub 3 in front view, but is positioned at the circumferentially equidistant position between the front and rear full blades 5F and 5R up to a height H of about 70% of the total height of the splitter blade 7, with the portion above about 70% of the total height being inclined from around the 70% position toward the distal end thereof.

The percentage 70% was determined through a numerical analysis or bench test as a range that will be affected by the tip leakage vortex W interfering with the leading edge 7*a* of the splitter blade 7.

In this way, only the portion above about 70% of the total height of the leading edge of the splitter blade is inclined from around the 70% position toward the distal end to be closer to the suction side of the full blade, and thus equalization of blade load between the full blades 5 and splitter blades 7 can be achieved by inclining only a minimum necessary area to avoid interference with the tip leakage vortex W.

As a result of even blade loading between the full blades 5 and splitter blades 7, a drop in the compressor performance can be prevented.

INDUSTRIAL APPLICABILITY

According to the present invention, in a centrifugal compressor impeller having full blades arranged adjacent each other to extend from a fluid inlet part to a fluid outlet part, and splitter blades provided between the full blades so as to extend from a point in the flow passage to the outlet part, the load distribution is made even between the shroud side and the hub side of splitter blades to increase the pressure ratio, whereby the efficiency and durability can be improved, and therefore the invention can suitably be applied to centrifugal compressor impellers.

The invention claimed is:

1. A centrifugal compressor impeller, comprising:

a plurality of full blades that stand equally spaced in a circumferential direction and extend from a fluid inlet part to a fluid outlet part on a surface of a hub; and splitter blades each of which is disposed in a flow passage formed between two of the full blades arranged adjacent to each other so as to extend from a downstream point on a downstream side of the fluid inlet part in the flow passage to the fluid outlet part, wherein the centrifugal compressor includes a tip clearance between tips of the full blades and a shroud, and a leading edge portion on a shroud side of each of the splitter blades is offset from a circumferentially equidistant position between said two of the full blades at the downstream point toward a suction side of a front side full blade which is disposed on a downstream side in a rotational direction of the centrifugal compressor impeller among said two of the full blades, while a trailing edge portion on a hub side of each of the splitter blades is offset from a circumferentially equidistant position between said two of the full blades at the fluid outlet part toward the suction side of the front side full blade, so that a tip leakage vortex flowing from the tip clearance toward the leading edge portion of each of the splitter blades flows over the leading edge portion of said each of the splitter blades, or so that the leading edge portion of each of the splitter blades conforms to a direction of the tip leakage vortex, and wherein a trailing edge portion on the shroud side of each of the splitter blades is offset from the circumferentially equidistant position between said two of the full blades at the fluid outlet part toward a pressure side of a rear side full blade which is disposed on an upstream side in the rotational direction of the centrifugal compressor impeller among said two of the full blades.

2. A centrifugal compressor impeller, comprising:

a plurality of full blades that stand equally spaced in a circumferential direction and extend from a fluid inlet part to a fluid outlet part on a surface of a hub; and splitter blades each of which is disposed in a flow passage formed between two of the full blades arranged adjacent to each other so as to extend from a downstream point on a downstream side of the fluid inlet part in the flow passage to the fluid outlet part, wherein the centrifugal compressor includes a tip clearance between tips of the full blades and a shroud, and a leading edge portion on a shroud side of each of the splitter blades is offset from a circumferentially equidistant position between said two of the full blades at the downstream point toward a suction side of a front side full blade which is disposed on a downstream side in a rotational direction of the centrifugal compressor impeller among said two of the full blades, while a trailing edge portion on a hub side of each of the splitter blades is offset from a circumferentially equidistant position between said two of the full blades at the fluid outlet part toward the suction side of the front side full blade, so that a tip leakage vortex flowing from the tip clearance toward the leading edge portion of each of the splitter blades flows over the leading edge portion of said each of the splitter blades, or so that the leading edge portion of each of the splitter blades conforms to a direction of the tip leakage vortex, and wherein a trailing edge portion on the shroud side of each of the splitter blades is offset from the circumferentially equidistant position between said two of the full blades at the fluid outlet part toward a pressure side of a rear side full blade which is disposed on an upstream side in the rotational direction of the centrifugal compressor impeller among said two of the full blades, and wherein ratios of cross-sectional areas at the leading edges and trailing edges of the splitter blades in respective passages on each side of each of the splitter blades at positions with a minimum distance from the splitter blade to a pressure side of the rear side full blade or the suction side of the front side full blade are made uniform.

3. A centrifugal compressor impeller, comprising:

a plurality of full blades that stand equally spaced in a circumferential direction and extend from a fluid inlet part to a fluid outlet part on a surface of a hub; and splitter blades each of which is disposed in a flow passage formed between two of the full blades arranged adjacent to each other so as to extend from a downstream point on a downstream side of the fluid inlet part in the flow passage to the fluid outlet part, wherein the centrifugal compressor includes a tip clearance between tips of the full blades and a shroud, and a leading edge portion on a shroud side of each of the splitter blades is offset from a circumferentially equidistant position between said two of the full blades at the downstream point toward a suction side of a front side full blade which is disposed on a downstream side in a rotational direction of the centrifugal compressor impeller among said two of the full blades, while a trailing edge portion on a hub side of each of the splitter blades is offset from a circumferentially equidistant position between said two of the full blades at the fluid outlet part toward the suction side of the front side full blade, so that a tip leakage vortex flowing from the tip clearance toward the leading edge portion of each of the splitter blades flows over the leading edge portion of said each of the splitter blades, or so that the leading edge portion of each of the splitter blades conforms to a direction of the tip leakage vortex, and wherein the leading edge portion on the shroud side of each of the splitter blades is offset from the circumferentially equidistant position between said two of the full blades at the downstream point toward the suction side of the front side full blade such that the leading edge portion is positioned at the circumferentially equidistant position between said two of the full blades at the downstream point up to about 70% of a total height of the splitter blades and portions above about 70% of the total height of the splitter blades are inclined from a point corresponding to about 70% of the total height toward distal ends thereof.

4. The centrifugal compressor impeller according to claim 3, wherein ratios of cross-sectional areas at the leading edges and trailing edges of the splitter blades in respective passages on each side of each of the splitter blades at positions with a minimum distance from the splitter blade to a pressure side of the rear side full blade or the suction side of the front side full blade are made uniform.

* * * * *